US007878243B2

(12) United States Patent
Goodwin et al.

(10) Patent No.: US 7,878,243 B2
(45) Date of Patent: Feb. 1, 2011

(54) METHOD AND APPARATUS FOR SAMPLING HIGH VISCOSITY FORMATION FLUIDS

(75) Inventors: Anthony R. H. Goodwin, Sugar Land, TX (US); Peter S. Hegeman, Stafford, TX (US); Julian J. Pop, Houston, TX (US); Ashley C. Kishino, Houston, TX (US); Gary J. Tustin, Cambridge (GB); Raymond V. Nold, III, Beasley, TX (US); Kai Hsu, Sugar Land, TX (US); Christopher S. Del Campo, Houston, TX (US); Ricardo Vasques, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 337 days.

(21) Appl. No.: 11/763,237

(22) Filed: Jun. 14, 2007

(65) Prior Publication Data

US 2008/0078581 A1 Apr. 3, 2008

Related U.S. Application Data

(60) Provisional application No. 60/845,332, filed on Sep. 18, 2006, provisional application No. 60/882,701, filed on Dec. 29, 2006.

(51) Int. Cl.
*E21B 49/08* (2006.01)
*E21B 49/10* (2006.01)

(52) U.S. Cl. ..... 166/264; 166/100; 73/152.24; 73/152.25; 73/152.26

(58) Field of Classification Search ..... 166/264, 166/100; 73/152.24, 152.25, 152.26
See application file for complete search history.

(56) References Cited

U.S. PATENT DOCUMENTS

| | | | | |
|---|---|---|---|---|
| 2,693,342 | A | | 11/1954 | Lynes |
| 3,104,712 | A | | 9/1963 | Whitten |
| 3,859,851 | A | | 1/1975 | Urbanosky |
| 4,127,169 | A | * | 11/1978 | Tubin et al. ..... 166/303 |
| 4,353,249 | A | | 10/1982 | Lagus et al. |
| 4,392,376 | A | | 7/1983 | Lagus et al. |
| 4,860,581 | A | | 8/1989 | Zimmerman et al. |

(Continued)

FOREIGN PATENT DOCUMENTS

GB 2418938 4/2006

(Continued)

OTHER PUBLICATIONS

Burgess, Keith et al., Formation Testing and Sampling Through Casing, Oilfield Review, Spring 2002, pp. 47-57.

*Primary Examiner*—Daniel P Stephenson
*Assistant Examiner*—Yong-Suk Ro
(74) *Attorney, Agent, or Firm*—Dave R. Hofman

(57) ABSTRACT

A formation fluid sampling tool is provided with a drill which drills into the formation in a manner perpendicular or oblique to the borehole wall. The tool comprises a mechanism for enhancing the mobility of the reservoir fluid, such as a heating element on the drill, hot fluid which is generated in the tool and injected into the drilled hole, or a solvent which is stored in the tool and injected by the tool into the drilled hole.

15 Claims, 13 Drawing Sheets

U.S. PATENT DOCUMENTS

| | | | | |
|---|---|---|---|---|
| 4,936,139 | A | 6/1990 | Zimmerman et al. | |
| 5,056,595 | A | 10/1991 | Desbrandes | |
| 6,065,544 | A | 5/2000 | Holbert | |
| 6,208,316 | B1 | 3/2001 | Cahill | |
| 6,269,882 | B1 * | 8/2001 | Wellington et al. | 166/303 |
| 6,301,959 | B1 | 10/2001 | Hrametz et al. | |
| 6,699,019 | B2 * | 3/2004 | Myers et al. | 417/334 |
| 6,755,246 | B2 | 6/2004 | Chen et al. | |
| 6,766,854 | B2 | 7/2004 | Ciglenec et al. | |
| 6,772,839 | B1 * | 8/2004 | Bond | 166/298 |
| 7,175,770 | B2 * | 2/2007 | Whisman, III | 210/747 |
| 7,347,262 | B2 * | 3/2008 | Tarvin et al. | 166/264 |
| 2003/0217845 | A1 | 11/2003 | Sherwood et al. | |
| 2004/0093937 | A1 | 5/2004 | Hashem | |
| 2004/0104341 | A1 | 6/2004 | Betancourt et al. | |
| 2005/0155760 | A1 | 7/2005 | Hill et al. | |
| 2005/0279499 | A1 * | 12/2005 | Tarvin et al. | 166/264 |
| 2006/0000606 | A1 | 1/2006 | Fields et al. | |
| 2006/0042793 | A1 | 3/2006 | Del Campo et al. | |
| 2006/0137873 | A1 | 6/2006 | Caudwell et al. | |
| 2006/0162935 | A1 | 7/2006 | MacDougall | |
| 2006/0248949 | A1 | 11/2006 | Gregory et al. | |
| 2007/0215348 | A1 | 9/2007 | Corre | |
| 2008/0066904 | A1 | 3/2008 | Van Hal et al. | |
| 2008/0078581 | A1 | 4/2008 | Goodwin et al. | |
| 2008/0156486 | A1 | 7/2008 | Ciglenec et al. | |
| 2009/0008079 | A1 | 1/2009 | Zazovsky et al. | |

FOREIGN PATENT DOCUMENTS

| | | |
|---|---|---|
| GB | 2420135 | 5/2006 |
| GB | 2431673 | 5/2007 |
| GB | 2445846 | 7/2008 |
| WO | WO2007048991 | 5/2007 |
| WO | WO2008036520 | 3/2008 |
| WO | WO2008150825 | 12/2008 |

* cited by examiner 16
18
SURFACE EQUIPMENT
DATA PROCESSOR
12
11
14
10

METHOD AND APPARATUS FOR SAMPLING HIGH VISCOSITY FORMATION FLUIDS

PRIORITY

This application claims priority from U.S. Provisional Application No. 60/845,332 filed Sep. 18, 2006 and U.S. Provisional Application No. 60/882,701filed Dec. 29, 2006. This application is also related to U.S. patent application Ser. No. 12/368,738, filed on Feb. 10, 2009, and titled "Single Packer System for Use in Heavy Oil Environments."

BACKGROUND

1. Field of this Disclosure

This invention relates broadly to oilfield exploration. More particularly, this invention relates to apparatus and methods for expediting the downhole sampling of formation hydrocarbons via formation modification.

2. State of the Art

One technique utilized in exploring a subsurface formation is to obtain samples of formation fluid downhole. Tools such as the MDT and the CHDT (both trademarks of Schlumberger) tools are extremely useful in obtaining and analyzing such samples.

The MDT tool or other sampling tools typically include a fluid entry port or tubular probe cooperatively arranged within one or more wall-engaging packers for isolating the port or probe from the borehole fluids, one or more sample chambers which are coupled to the fluid entry by a flow line having one or more control valves arranged therein, means for controlling a pressure drop between the formation pressure and sample chamber pressure, and sensors for obtaining information relating to the fluids. Examples of sampling tools may be found in U.S. Pat. No. 3,104,712 to Whitten, U.S. Pat. No. 3,859,851 to Urbanosky, and U.S. Pat. No. 4,860,581 to Zimmerman et al., which are hereby incorporated by reference herein in their entireties). The sensors may include pressure transducers for monitoring fluid pressure and temperature. In addition, optical sensors may be supplied by an OFA, CFA or LFA (all trademarks of Schlumberger) module in order to determine the phase, the chemical composition, etc, of the fluid being admitted into the tool.

The use of the CHDT tool is similar in various aspects to the user of the MDT tool, but mostly in cased boreholes. The CHDT tool includes a mechanism for perforating the casing with a drilling mechanism (see, e.g., "Formation Testing and Sampling through Casing", *Oilfield Review*, Spring 2002 which is hereby incorporated by reference herein in its entirety) and for plugging the casing after testing. The CHDT tool may alternatively be used in open hole, for example with modifications as shown in U.S. Patent Application Pub. No. 2005/0279499 or U.S. Patent Application Pub. No. 2006/0000606, both assigned to the same assignee of the present invention, and both included herein by reference.

The MDT and CHDT tools in their normal applications are used to obtain formation oil samples with a low viscosity; typically up to 30 cP. In certain circumstances, oils with a higher viscosity have been sampled, but the sampling process often requires several adaptations and can take many hours. It is believed that the maximum viscosity of an oil that has been sampled using an MDT or CHDT tool is approximately 3200 cP.

It will be appreciated by those skilled in the art that exploitation of more viscous hydrocarbons is becoming increasingly important due to the depletion of conventional low viscosity hydrocarbon reserves. Sampling viscous oils for reservoir characterization is very challenging as oils with a higher viscosity have a low mobility. Thus, depending on the local circumstances, viscous oils are very difficult to pump out of the formation. In fact, the low mobility of these oils often results in very long sampling times or makes it impossible to retrieve a representative sample, for example, because of the formation of emulsions. In some cases, the low mobility of these oils even makes it impossible to retrieve a sample. In addition, if sampling times are too long there is an increased probability that the tool will get stuck in the borehole.

Tools and techniques have been proposed for sampling heavy oils and bitumen, for example as shown in International Application Publication No. WO2007/048991, assigned to the same assignee as the present invention, and incorporated by reference herein.

While straddle packers mounted on the sampling tool above and below a sampling port, or large diameter packer can improve the flow of oil into the sampling tool, there is still a need for sampling tools and sampling methods that can be used, amongst other things, for sampling viscous hydrocarbons.

SUMMARY

It is therefore an object of this disclosure to provide tools and methods which expedite the sampling of formation hydrocarbons, and particularly, although not exclusively, the sampling of high viscosity hydrocarbons.

In accord with this object, which will be discussed in detail below, the tool of this disclosure is provided with means for drilling a hole into the formation in a manner perpendicular or oblique to the borehole. In one preferred embodiment, the tool also includes means introduced into the drilled hole for enhancing the mobility of the reservoir fluid. In one embodiment the means for enhancing mobility is a heating element on the means for drilling. In particular, the means for drilling could be itself or could be replaced by a resistive heater. In another embodiment, the means for enhancing mobility is a hot fluid which is generated by the tool and injected into the drilled hole. In another embodiment, the means for enhancing mobility is a solvent which is stored in the tool and injected by the tool into the drilled hole. In another embodiment, the means for enhancing mobility is a transmitter which emits electromagnetic radiation at a frequency coincident with an absorption frequency of a molecular mode of motion of a formation hydrocarbon fluid, connate water, or an injected fluid. In another embodiment, the radiation could be emitted at radio frequencies or at frequencies of the order of the kHz so that the formation near the drilled hole is heated. In another embodiment, means of inserting a heat pipe or a heat transfer device into the drilled hole are included in the tool and thermal energy is transported from the tool to the formation to heat the oil. The heat could be generated within the tool by various ways. In another embodiment, the means for enhancing mobility is an acoustic transducer which stimulates the oil or adjacent fluid either directly or indirectly. In another embodiment, the means for enhancing mobility is an exothermic reaction. The reaction may be initiated within the tool between two reactants. Alternatively, the reaction may be performed in the drilled hole with a granular catalyst injected with reagents. In particular, the reactants may include hydrogen peroxide. Optionally, the reaction may involve a catalyst that is not consumed during the reaction. As a particular type of exothermic reaction, some embodiments use combustion. Combustion could involve fluid or gas brought down hole with the tool or extracted from the formation. In particular, in-situ (controlled) combustion may be used as the means for enhancing the mobility.

The tool embodiments of this disclosure can be used in conjunction with methods. In one method a single hole is drilled into the formation from the borehole. Upon or after drilling, either with the means for drilling or separately therefrom, the means for enhancing the mobility of the reservoir fluid may be delivered to the formation, for example introduced into the drilled hole. The reservoir fluid is then pulled from the formation either from the drilled hole or from a sampling probe in contact with the formation near the drilled hole. In another method, at least two holes are drilled into the formation from the borehole. Means for enhancing the mobility of the reservoir fluid may be delivered to the formation, for example introduced into at least one of the holes. The reservoir fluid is then pulled from the formation, from the other hole, or from both holes, or from a sampling probe in contact with the formation near the drilled holes. In yet another method, at least two intersecting holes are drilled into the formation from the borehole. Means for enhancing the mobility of the reservoir may be delivered to the formation, for example introduced into at least one of the holes or circulated through the holes, and reservoir fluid is pulled from the formation via either or both of the holes, or from a sampling probe in contact with the formation near the drilled holes.

Additional objects and advantages of this disclosure will become apparent to those skilled in the art upon reference to the detailed description taken in conjunction with the provided figures.

DETAILED DESCRIPTION

Figure 1:
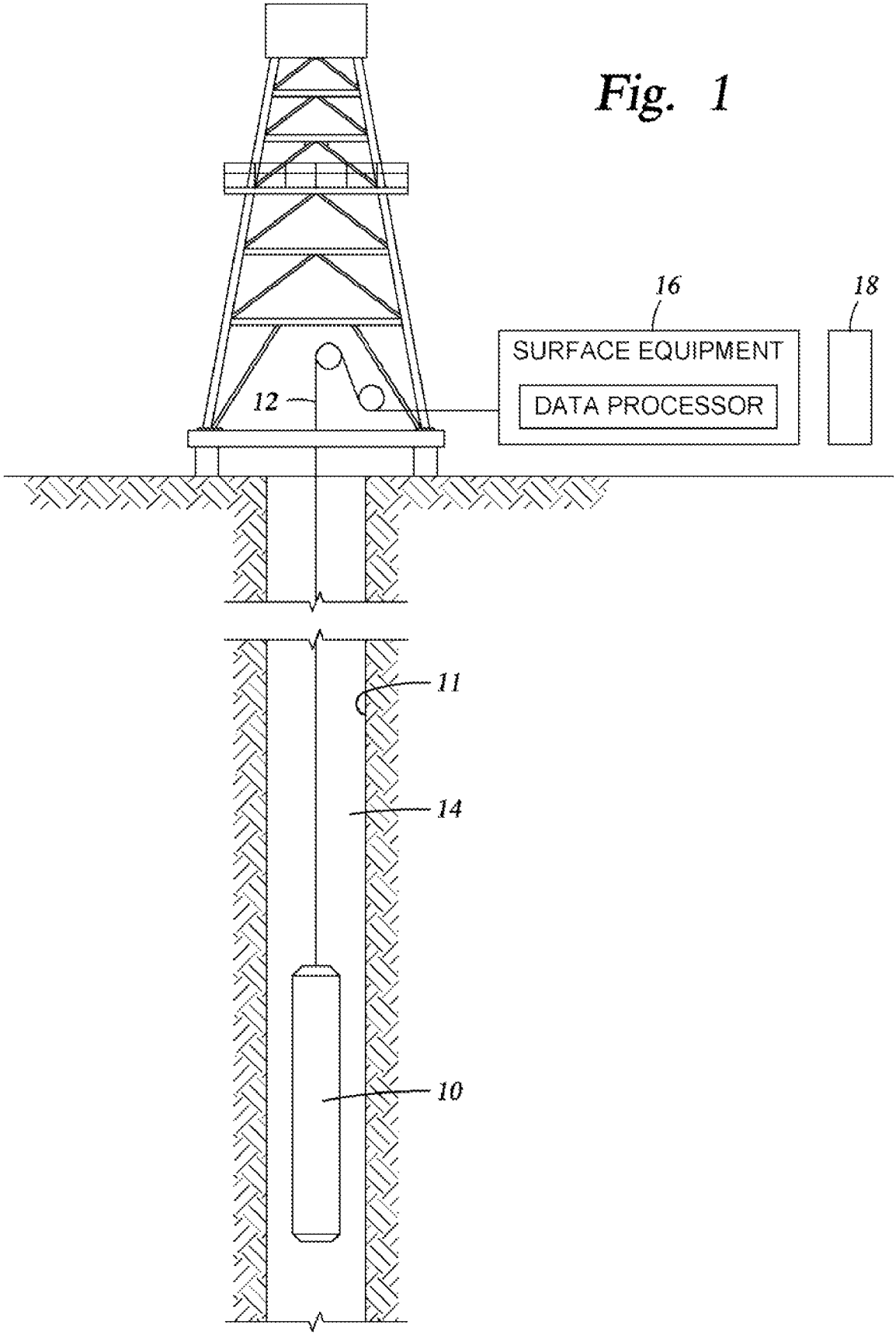
FIG. 1 is a schematic representation of a system deployed via a wire line in a wellbore and coupled to surface equipment.

Turning now to FIG. 1, the basics of a reservoir exploration (borehole logging) system are shown. A borehole tool or sonde 10 is shown suspended in a borehole 14 of a formation 11 by a cable 12, although it could be located at the end of coil tubing, coupled to a drill-pipe, or deployed using any other means used in the industry for deploying borehole tools. Cable 12 not only physically supports the borehole tool 10, but typically, signals are sent via the cable 12 from the borehole tool 10 to surface located equipment 16. In addition, cable 12 is often used to provide electrical power from the surface to the borehole tool 10. The surface located equipment 16 may include a signal processor, a computer, dedicated circuitry, or the like which is well known in the art. Typically, the equipment/signal processor 16 takes the information sent uphole by the borehole logging system 10, processes the information, and generates a suitable record such as a display log 18 or the like. Suitably, the information may also be displayed on a screen and recorded on a data storage medium or the like.

Figure 2:
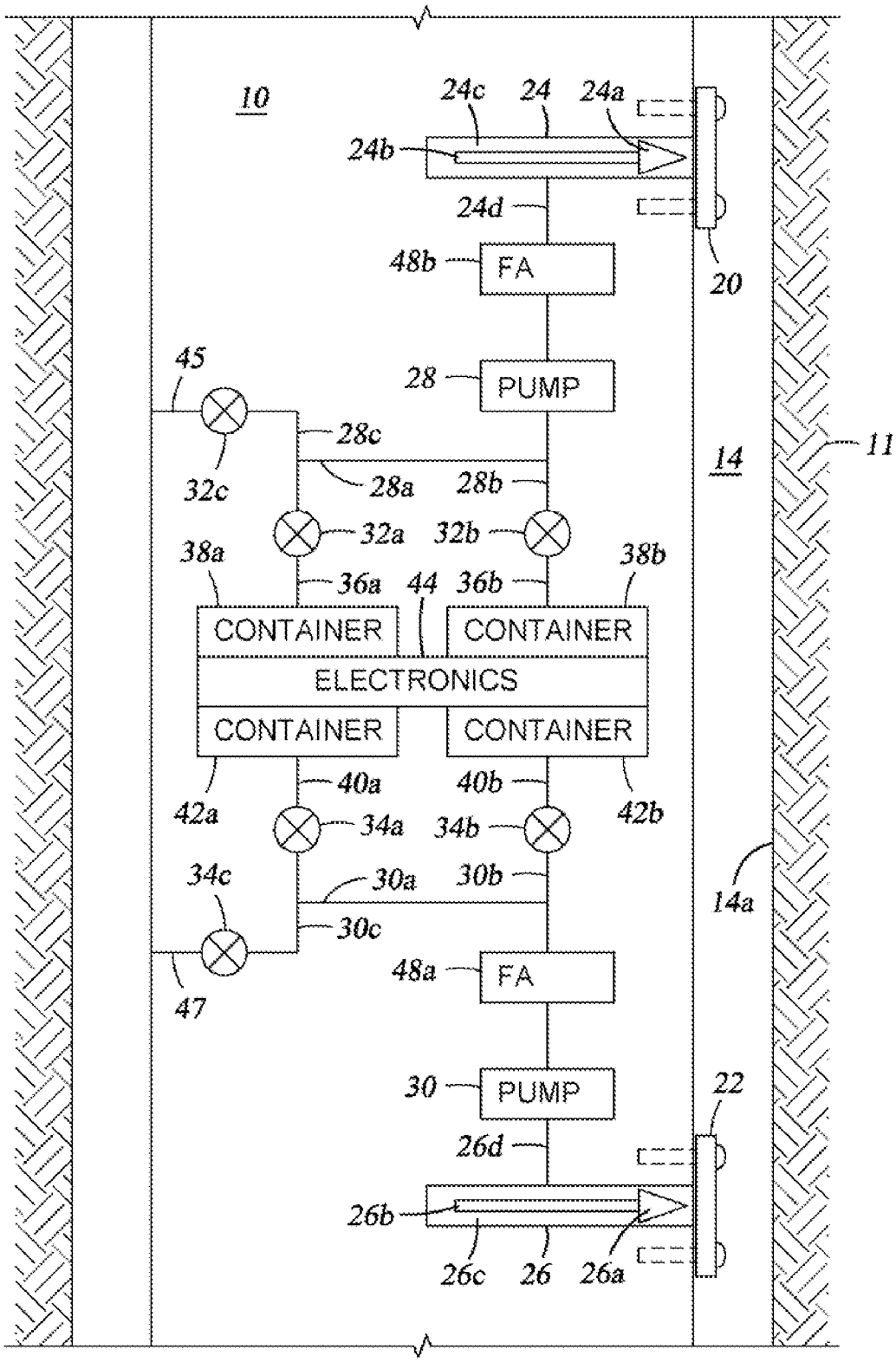
FIG. 2 is a schematic illustration of a sampling tool having formation drilling means, shown deployed downhole and ready to be used.

Turning now to FIG. 2, a first embodiment of a tool 10 according to this disclosure is shown schematically inside the borehole 14 of the formation 11. The tool 10 includes two packers 20, 22 which are extendable out of the tool toward the borehole wall 14*a*. Each packer 20, 22, surrounds a respective drilling means 24, 26. Suitable packers include packers as shown in U.S. Patent Application Pub. No. 2006/0000606. Alternatively or additionally, inflatable straddle packers (not shown) may be used. A suitable drilling means may be that found in the Cased Hole Dynamics Tester (CHDT) tool referred to above. The drilling means each include a drill bit 24*a*, 26*a* and a respective drill shaft 24*b*, 26*b*. In accord with one embodiment of the disclosure, the drill shafts 24*b*, 26*b* are surrounded by annular fluid flow spaces 24*c*, 26*c*. The fluid flow spaces 24*c*, 26*c* are coupled by flowlines 24*d*, 26*d* to respective pumps 28, 30. The pumps 28, 30 are coupled by respective flowlines 28*a*, 28*b* 28*c*, 30*a*, 30*b*, 30*c* to respective valves 32*a*, 32*b*, 32*c*, 34*a*, 34*b* 34*c*. The valves 32*a*, 32*b* are coupled by respective flowlines 36*a*, 36*b* to respective fluid containers 38*a*, 38*b*. The valves 34*a*, 34*b* are coupled by respective flow lines 40*a*, 40*b* to respective fluid containers 42*a*, 42*b*. The valves 32*c* and 34*c* are coupled by respective flow lines 45 and 47 to the ambient environment (for example the borehole). An optional fluid analyzer (FA) 48*a* is coupled to the pump 30 and is capable amongst other things of monitoring a property of the fluid drawn at the packer 22 and exiting the pump 30. Another optional fluid analyzer (FA) 48*b* is coupled to the pump 28 and is capable amongst other things of monitoring a property of the fluid drawn at the packer 20 and entering the pump 28. A fluid analyzer is capable of measuring in situ a fluid property and may comprise one or more of a pressure sensor, a temperature sensor, a resistivity and/or a conductivity sensor. Optical sensors may be supplied by an OFA, CFA or LFA as discussed above, or by a sensor capable of measuring the fluorescence of the fluid in the flow line. Alternatively or additionally, the density and/or the viscosity of the fluid in the flow line may be measured by one or more sensors known in the art, including sensor(s) based on acoustic and NMR measurement principles. One example of sensor based on acoustic is a viscometer including a vibrating object, and in particular the sensor described in U.S. Patent Application Pub. No. 2006/0137873. Note that the location of fluid analyzers with respect to pumps and packers may be adapted for various use of tool 10 by using a modular design as well known in the art, and may be placed on both side of a pump. Electronics 44 are preferably provided to control the valves, the pumps and the drilling means, to communicate with the surface equipment (16 in FIG. 1), and/or to analyze the contents of the fluid containers, etc, in conjunction with the optional fluid analyzers 48*a*-*b* and/or other sensors (not shown).

Figure 2A:
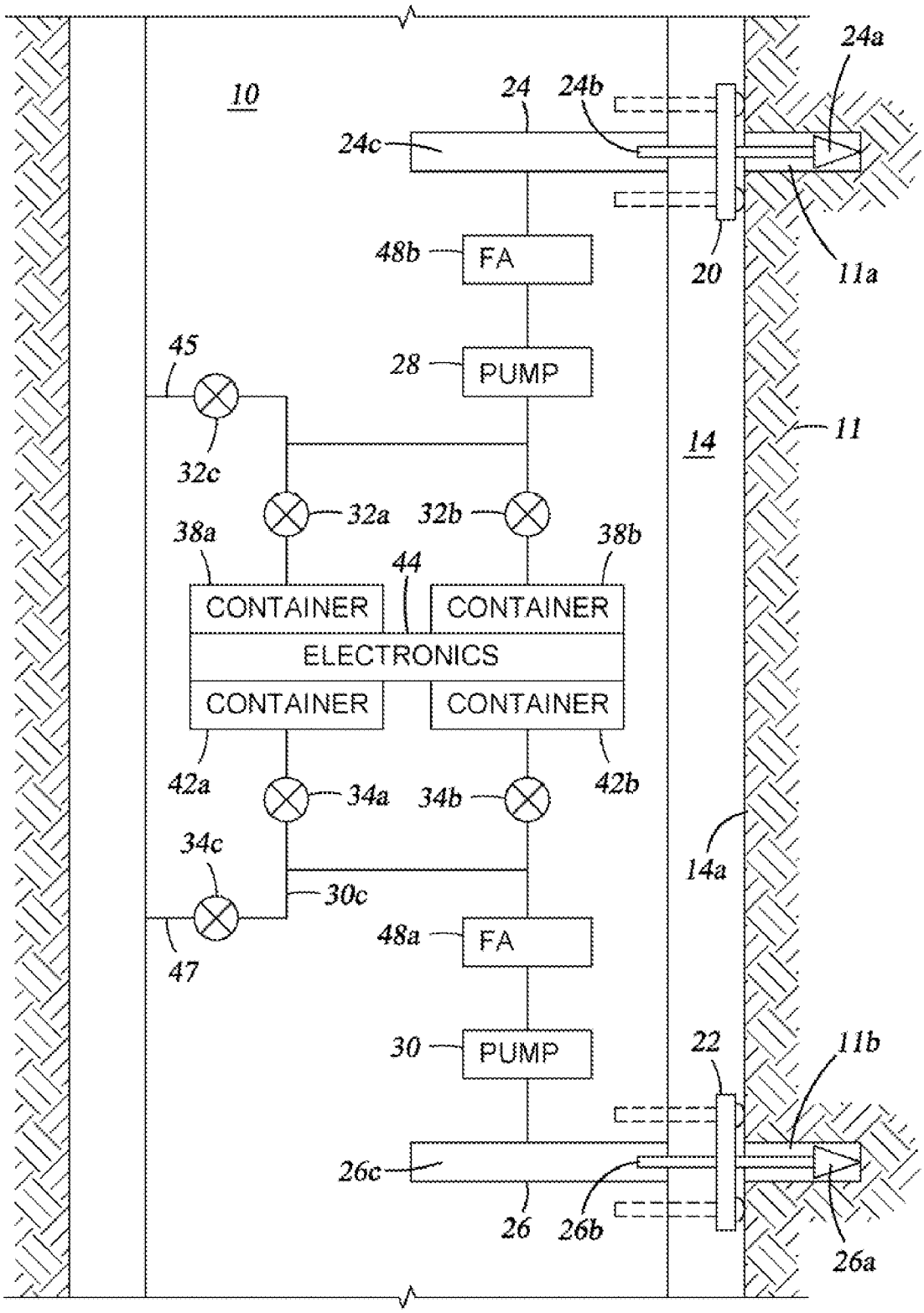
FIG. 2A is a schematic illustration of the sampling tool of FIG. 2 deployed downhole and being used according to some of the methods of this disclosure.

Referring now to FIG. 2A, according to one method, the packers 20, 22 of the tool 10 are extended out of the tool to engage the borehole wall 14*a*, and preferably seal one or more locations along the borehole wall. The drilling means 24, 26 are activated such that the drill bits 24*a*, 26*a* drill holes 11*a*, 11*b* through the isolated locations of the borehole wall 14*a* into the formation 11. When the tool 10 is so deployed, the annular fluid flow spaces 24*c*, 26*c* are in fluid communication with the holes 11*a*, 11*b* in the formation 11, and essentially sealed to the fluids in the wellbore. According to this first method, the valves 32*a*, 32*b* are opened and the pump 28 is activated such that the contents of the fluid containers 38*a* and 38*b* are pumped into the fluid flow space 24*c*, through the packer 20 and into the hole 11*a*. The contents of the containers 38*a* and 38*b* may be chosen so that they react with each other exothermically as disclosed in commonly-owned U.S. Ser. No. 11/562,908 which is hereby incorporated by reference herein in its entirety. The hot fluid enters the porous formation 11 and mobilizes formation fluids in its vicinity. Pump 30 is then activated to extract mobilized formation fluid from the hole 11*b*. The fluids extracted by pump 30 may be sent through the optical analyzer 48*a* in order to determine whether they should be stored or dumped. If they are to be stored, one or more of valves 34*a*, 34*b* are opened and the fluid is sent to one or both of the containers 42*a*, 42*b* for storage. If initially or later, the fluids being extracted are to be dumped, valve 34*c* is opened. When it is desired to move the tool 10, the drills 24, 26 are retracted into the tool, and packers 20, 22 are disengaged from the borehole wall. The tool 10 may then be moved to another location in the borehole, or brought uphole so that the samples can be accessed and analyzed uphole.

According to an alternate embodiment, the tool 10 may be used for in-situ (controlled) combustion. In this alternate embodiment, at least two drilled holes, as shown for example by holes 11*a* and 11*b* in FIG. 2A, may be used. In a first example, in-situ combustion is initialed in a first hole (for example 11*a*). Air, oxygen or air together with oxygen may be pumped, for example using pump 28, into the first hole to sustain the combustion process. The injection rate of air or oxygen may be varied by the tool, for example to control the combustion rate. In addition, steam or water may also be pumped in the first hole for controlling the combustion front temperature. The combustion may consume some of the in-situ oil and produce heat, combustion gases and water vapor. Alternatively, or additionally, a hydrocarbon may be mixed to and injected with the air or oxygen. The injected mixture may also sustain a combustion process. The ratio of oxygen to hydrocarbon may be controlled so that the chemical composition of the mixture is within the combustion boundaries.

The combustion products may reduce the viscosity of the oil and serve to drive the oil ahead of the combustion front. In particular, part of the formation oil may be driven towards a second drilled hole where it can be pumped into the tool. For facilitating the sampling process, the second hole (for example 11*b*) may be kept at a lower pressure, for example using pump 30. The composition of the produced oil may be monitored, for example at fluid analyzer 48*a*, to determine when to selectively sample the produced stream, for example in fluid containers 42*a* or 42*b*. The combustion products in the hole in which the combustion was initiated may also be monitored, for example they may be sampled in the tool and analyzed at fluid analyzer 48*b*. The heat generated by the combustion may be recorded by temperature sensors to control the efficiency of the downhole combustion process and/or to collect fundamental reaction process data. The temperature sensors may be located in a flow line (part of fluid analyzer 48*a*), or remotely deployed (not shown) in the formation as known in the art. The data collected by the sensors on the tool may be used to model or stimulate large-scale in-situ combustion processes, as used for example in reservoir exploitation.

In a second example of in-situ initiated combustion, air/oxygen may be injected into one first drilled hole and combustion may be initiated in one second drilled hole. It may be necessary to inject air/oxygen into the second hole in which the combustion is initiated in order to sustain the reaction for some time until the combustion is sustained by oxygen injected in the first drilled hole. In this method the formation crude oil moves from upstream of the combustion front and through the combustion front and burned zone towards the hole in which the combustion is initiated and, in so doing, is decomposed and refined into a range of heavier and light components, the heavier components, most likely, being left behind as a residue. In using this method, it is preferable to insure that there is sufficient initial permeability of the formation to air/oxygen so the air/oxygen may reach the reaction front and cause the combustion front to propagate towards the first hole in which the oxygen is being injected. The nature of this combustion process is, however, to enhance the permeability to injected gas with time. As mentioned previously, information may be gathered to both control the reaction kinetics and to gather fundamental physical and property data for later use in modeling the physics/chemistry of the exploitation processes.

Air, oxygen or their combination may be either pumped from surface through a separate conduit (not shown) to the tool or it may be generated down hole within the tool via a chemical, oxygen generating, process and/or reaction. Alternatively, air or oxygen may be stored in one of the fluid containers (for example 38*a* or 38*b*) and delivered to the formation. Moreover, steam or water may also be either pumped from surface through a separate conduit (not shown) to the tool or it may be conveyed down hole within the tool.

Using the same tool 10, other methods may be implemented. For example, the container 42*a* may be filled with a hot fluid which optionally is generated downhole by heating elements (not shown) or by any technique described in previously incorporated Ser. No. 11/562,908. The hot fluid is injected into the hole 11*b* and mobilized formation fluid can then be extracted from the hole 11*b* by reversing the pump 30. The fluids extracted from the hole 11*b* may then be analyzed in the fluid analyzer (FA) 48*a* over a period of time in order to determine whether they should be stored or dumped. For example, fluid initially extracted from the hole 11*b* may contain a significant amount of the hot fluid which was injected, and that fluid may either be dumped into the borehole via flow line 30*c*, valve 34*c* and flow line 47, or reinjected into the formation. After a period of time, the fluid being extracted may be substantially pure formation fluid (defined herein as 90% or more pure). If it is desirable to sample the substantially pure formation fluid, that fluid may be fed to a previously empty container, e.g., container 42*b*.

Those skilled in the art will appreciate that since injection and fluid extraction from only a single hole is required, that according to another embodiment of the tool, only a single drill bit, packer, pump, etc., is required rather than the two shown in FIGS. 2 and 2A. In fact, even where two hole are desired, only a single drill bit, packer, pump etc. is required, as a first hole can be drilled, fluid injected into that hole, the tool then moved, and then a second hole can be drilled for sampling. It will also be appreciated that where a single drill bit is provided, it may still be desirable to include two packers or a packer and a probe, two pumps, etc. By having an additional packer or probe, and as described hereinafter, it is easier to sample formation fluids which are mobilized away from the drilled hole.

Thus, according to another method, one container of the tool 10 may contain a mobility enhancer, such as by way of example and not limitation a miscible solvent such as a halogenated or otherwise polar normally liquid hydrocarbon, and most preferably a chlorinated solvent in which asphaltenes dissolve, or hot water, or steam, or carbon dioxide. Other containers may be used to collect mobilized formation fluid samples at different formation locations. For example, tool 10 can be set in the borehole and used to drill through the borehole wall into the formation to generate hole 11*a*. Mobility enhancer stored in container 38*a* can be injected into hole 11*a* through use of pump 28. After a period of time, if desired, pump 28 can be reversed, and mobilized formation fluid can be collected via hole 11*a* and stored in container 38*b* or dumped as desired, for example, based on information collected by the fluid analyzer (FA) 48*b*. At the same time, or at some other time earlier or later, a second pump 30 can be activated if desired in order to pull mobilized formation fluids from the formation at a second location removed from hole 11*a* via the packer 22. Again, these fluids can be stored or dumped as desired. After the desired sampling is completed, tool 10 can be moved to another location, and one or both of pumps 28 and 30 can be activated to pull yet additional formation fluids from the formation which may be have been mobilized via the injection of the mobility enhancer into hole 11*a*.

As illustrated in FIG. 2A, in one embodiment the drilled holes are substantially perpendicular to the borehole wall 14*a*. However, as described in more detail below with reference to FIGS. 7 and 7A, holes may be drilled obliquely relative to the borehole wall. According to any of the methods, the fluid for enhancing mobility can be a hot fluid which is made hot at the surface before lowering the tool downhole or is made hot downhole as needed. Alternatively, hot fluid from the surface may be fed to the downhole tool via tubing (not shown). A solvent or a hot solvent can also be used to enhance mobility. The obtained sample may be brought to the surface for analysis and/or it may be analyzed downhole using an optical analyzer or other tools.

While FIGS. 2 and 2A have been described with fluid injection located uphole of fluid collection, it should be appreciated by those skilled in the art that those locations could be reversed. Also, while particular methods have been described for utilizing the tool shown in FIGS. 2 and 2A, other methods could be utilized. For example, mobility enhancing fluids may be injected through both holes 11*a* and 11*b* until sufficient mobility is achieved to allow sampling. According to another method, only the injection site is drilled and the sample is taken from a porous borehole wall location.

Figure 3:
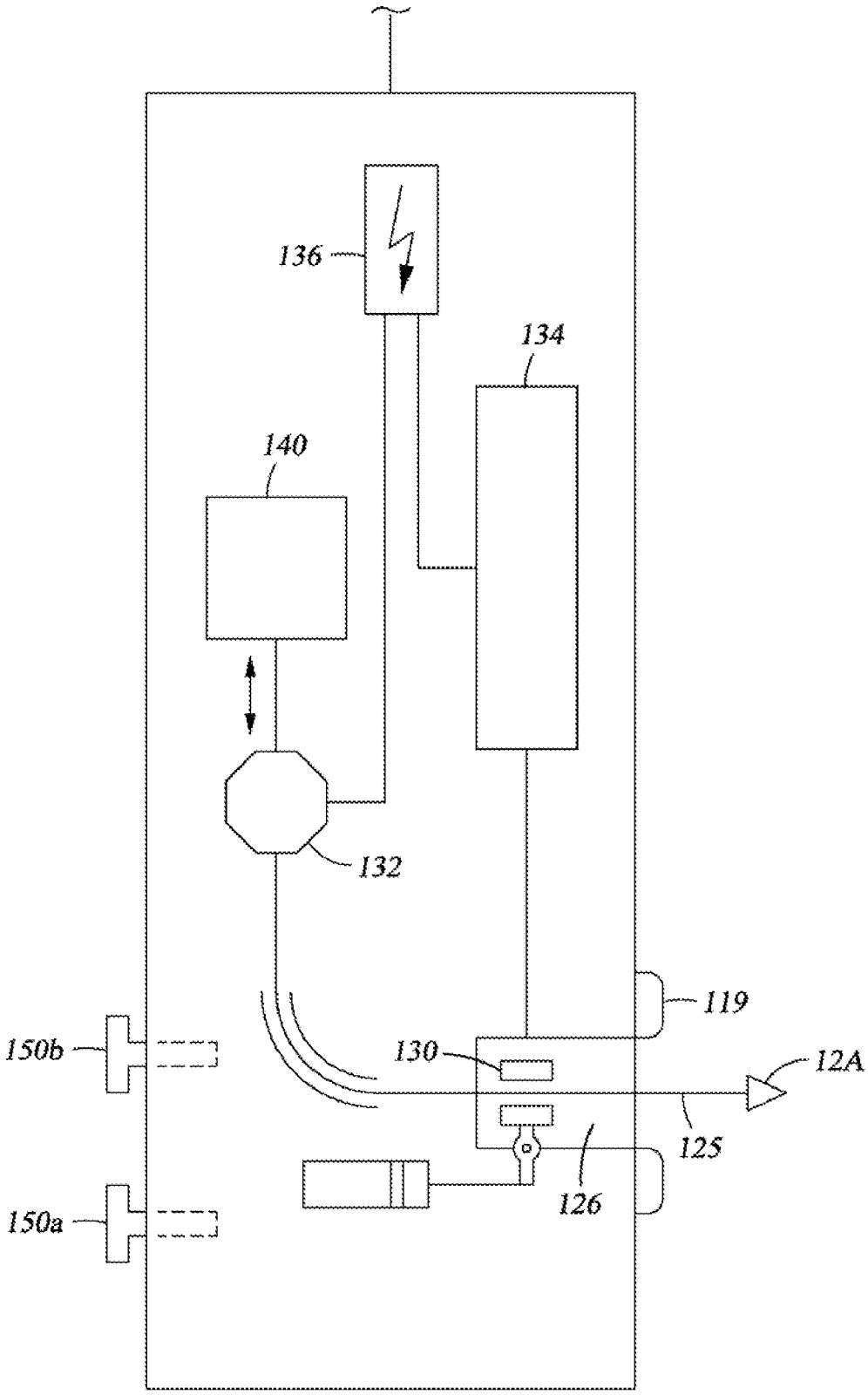
FIG. 3 is a schematic illustration of an alternate sampling tool having formation drilling means.

Turning now to FIG. 3, a second embodiment of a tool 110 according to this disclosure is shown. The tool includes a drill bit 124 having a shaft 125. The drill shaft 125 is preferably provided with a shaft guide 130. The drill bit 124 is driven by a motor 132. The motor 132 and the drill shaft 125 can be extended from or retracted into the tool with the displacement mechanism 140. Such displacement mechanism comprises for example a rotative motor coupled to a lead screw. The drill bit and shaft are surrounded by a packer 119. The packer 119 may be placed into sealing engagement with the wellbore wall (not shown) by activating the setting pistons 150*a*-150*b*. Alternatively, the tool 110 may be equipped with an extendable packer mounted on a backing plate, as shown for example in FIGS. 2 and 2A. As will be appreciated by those skilled in the art, formation fluids can flow through the annulus 126 between the drill shaft 125 and the packer 119 into the tool 110. In this example, a pump 134 is used to generate a pressure differential between the tool and the formation. Thus, the flow of formation fluids is enhanced by increasing a pressure differential.

As shown in FIG. 3, the motor 132 is powered by a power supply 136 which may also power heating elements (not shown) and the pump 134 for collecting formation fluid. Such a power supply may comprise, for example, a powerful chemical source such as a battery or a fuel cell, an alternator driven by a turbine which itself is driven by the flow of circulating well fluid as in the case of a drilling-type tool, etc. Those skilled in the art will appreciate that a power supply may not be needed if the power requirements can be met by the uphole equipment and conducted to the tool via, for example, the cable that suspends it. (See, cable 12 in FIG. 1)

While not shown in FIG. 3, tool 110 can include a plurality of drill bits with one or more of the bits having a heating element thereon. In addition, tool 110 can be provided with all or some of the aspects of the embodiment of FIGS. 2 and 2A, including, but not limited to fluid mobility enhancers, multiple pumps, containers, valves, a fluid analyzer (FA), etc. Moreover, tool 110 can be provided with all or some of the aspects of the hereinafter described embodiment of FIG. 4 or 5. Also, tool 110 can be used in conjunction with any of the methods described above with reference to FIGS. 2 and 2A. Similarly, some components of tool 110 may be used for energizing and deploying drill bits 24*a* and 26*a* of the tool 10 of FIGS. 2 and 2A.

Figure 4:
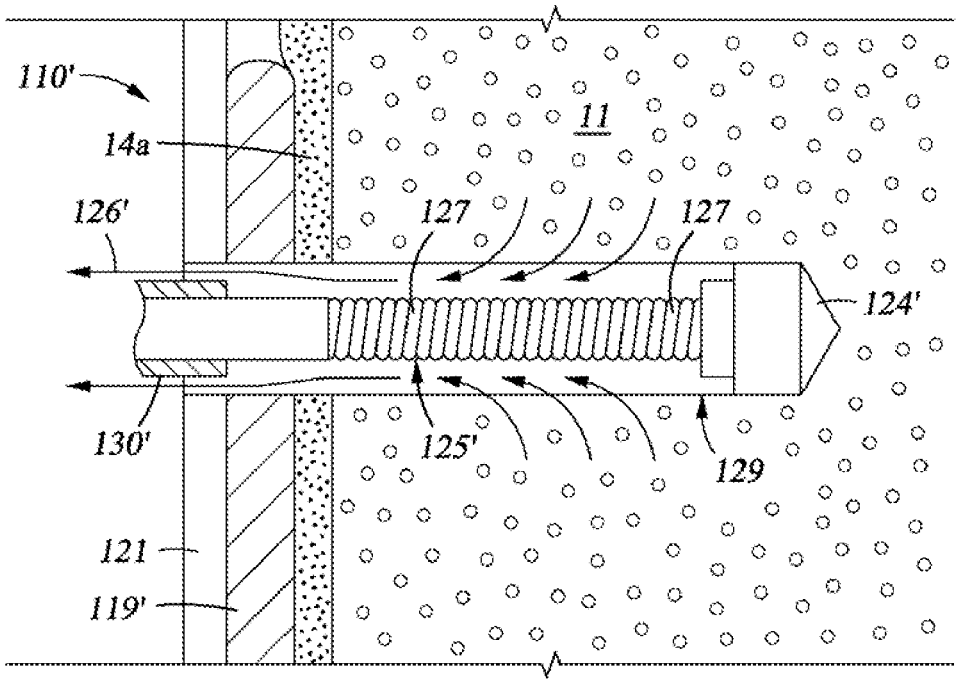
FIG. 4 is a schematic illustration of a packer portion of a tool, for example the tool of FIG. 3, having a heating element mounted on a drill shaft.

FIG. 4 shows in more details a probe portion of a tool 110', for example similar to the tool 110 of FIG. 3. A heating element 127 is provided about the shaft 125'. The heating element may comprise a resistive wire wound up around the shaft 125'. The drill bit and shaft are surrounded by a packer 119' and a packer backing plate 121. The drill bit 124' extends out of the tool 110' while drilling a hole 129 through the mud cake wall 14*a* of the borehole into the formation 11. The drill bit may be piloted by the tool 110' using the shaft guide 130'.

According to an alternate embodiment, the heating element 127 may comprise an antenna or coil which emits electromagnetic radiation. It should be noted that the frequency of the electromagnetic radiation can vary from kHz to GHz. The electromagnetic radiation power may be partially absorbed by the formation hydrocarbon fluid, connate water, or a fluid injected in the formation 11 by the tool 110'. The frequency of the electromagnetic radiation may be selected by considering the following elements. The power absorption mechanism is typically dipole relaxation. Thus, the power absorption characteristics usually vary from fluids to fluid. The power absorption characteristics of a fluid are related to the complex electric permittivity of this fluid, which can be measured in a laboratory. The absorption maxima occur about the frequencies corresponding to the maxima of the complex part of the permittivity. Also, it should be noted that the penetration of the electromagnetic wave decreases with increasing frequency, and that the absorption coefficient is about the reciprocal of the penetration depth and decreases as the frequency decreases. In some cases, the power absorption may be significant at frequencies coincident with an absorption frequency of a molecular mode of motion other than dipole relaxation.

In one example the coil is wound up around the shaft and generate current loops in the formation 11 that encircle the hole 129. According to another alternate embodiment, the heating element 127 may be replaced by an acoustic transducer (e.g. ultrasound) which stimulates the oil or adjacent fluid either directly or indirectly. For example, the ultrasonic transducer 127 may vibrate the drill bit 124' axially and generate acoustical waves in the formation 11. As shown in FIG. 3, the heating element or the acoustic transmitter 127 may be located on the shaft 125 of a drilling device. In these configurations, a sufficiently robust shaft, as already used in the industry, is desirable, even if it may not be possible to drill perpendicular to the borehole immediately after exiting the tool.

According to one exemplary method, the tool 110' may be used to drill a hole 129 in the formation 11. The mobility of the oil in the vicinity of the hole 129 may be enhanced by delivering heat, and or vibrations to the formation 11, utilizing the element 127. For example, the heating element 127 can be activated through electrical control of the tool 110' and used as a mobility enhancer in order to expedite flow of formation fluids. As will be appreciated by those skilled in the art, formation fluids can flow through the annulus 126' between the drill shaft 125 and the hole 129 into the tool 110'. The packer 119' is preferably pressed against the formation for sealing the annulus 126' from fluid in the wellbore.

Figure 5:
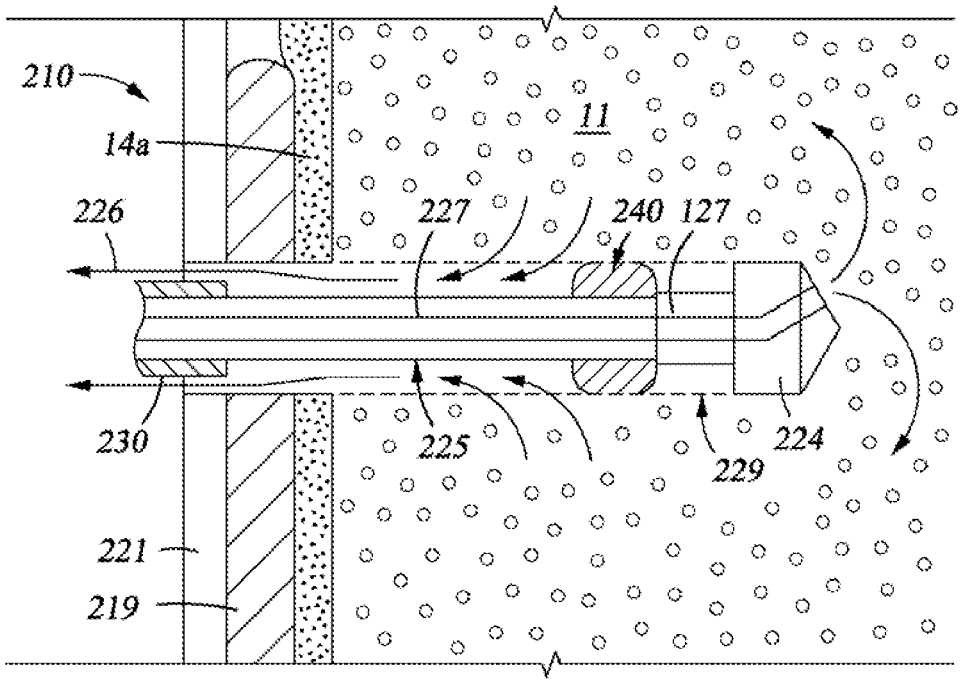
FIG. 5 is a schematic illustration of an alternate packer portion of a tool, for example the tool of FIG. 3, having a flow line in a drill shaft.

FIG. 5 illustrates a probe portion of a third embodiment of a tool 210 according to this disclosure. Here the tool includes a drill bit 224 having a shaft 225 with a fluid passage 227 that extends through the shaft 225 and out of the bit 224. As shown in FIG. 4, the distal end of the fluid passage 227 is angled so that it does not extend out of the very tip of the bit 224 so as to not weaken the bit. The drill bit and shaft are surrounded by a packer 219 and a packer backing plate 221. The drill bit is used to drill a hole 229 through the mud cake wall 14*a* of the borehole and into the formation 11. A mobility enhancing fluid is injected into the formation 11 via the fluid passage 227. Formation fluid is withdrawn via the annular passage 226 between the shaft 225 and the hole 229. Optionally, a compression packer 240 is provided on the shaft 225 near the bit 224 to isolate the bit from the annular passage 226.

According to one method, the probe portion of FIG. 5 may be used for analyzing the in-situ combustion of oil contained in the formation 11. The drill bit 224 and drill shaft 225 are used to drill a single hole 229 in the formation 11. The flow line 227 is used for injecting oxygen or air, thus sustaining a combustion reaction of the formation oil. Fluids are recovered from the annulus 226. The recovered fluid may consist of reaction products, decomposed/cracked oil, etc. The composition of the recovered fluid may, however, be of great interest and can be useful to those versed in the art of simulating in-situ combustion. Indeed, it is believed that there is no available method for collecting information regarding in-situ combustion under down hole conditions prior to field exploitation.

While not shown in FIG. 5, tool 210 can include a plurality of drill bits with one or more of the bits having a shaft with a fluid passage extending therethrough. In addition, tool 210 can be provided with all or some of the aspects of the embodiment of FIGS. 2 and 2A, including, but not limited to fluid mobility enhancers, multiple pumps, containers, valves, a fluid analyzer (FA), etc. Similarly, tool 210 can be provided with all or some of the aspects of the hereinafter described embodiment of FIG. 3. In addition, tool 210 can be used in conjunction with any of the methods described above with reference to FIGS. 2 and 2A. Moreover, the drilling means and the flow line may be separate elements in the tool, for example as shown in U.S. Patent Application Pub. No. 2005/0279.

Figure 6A:
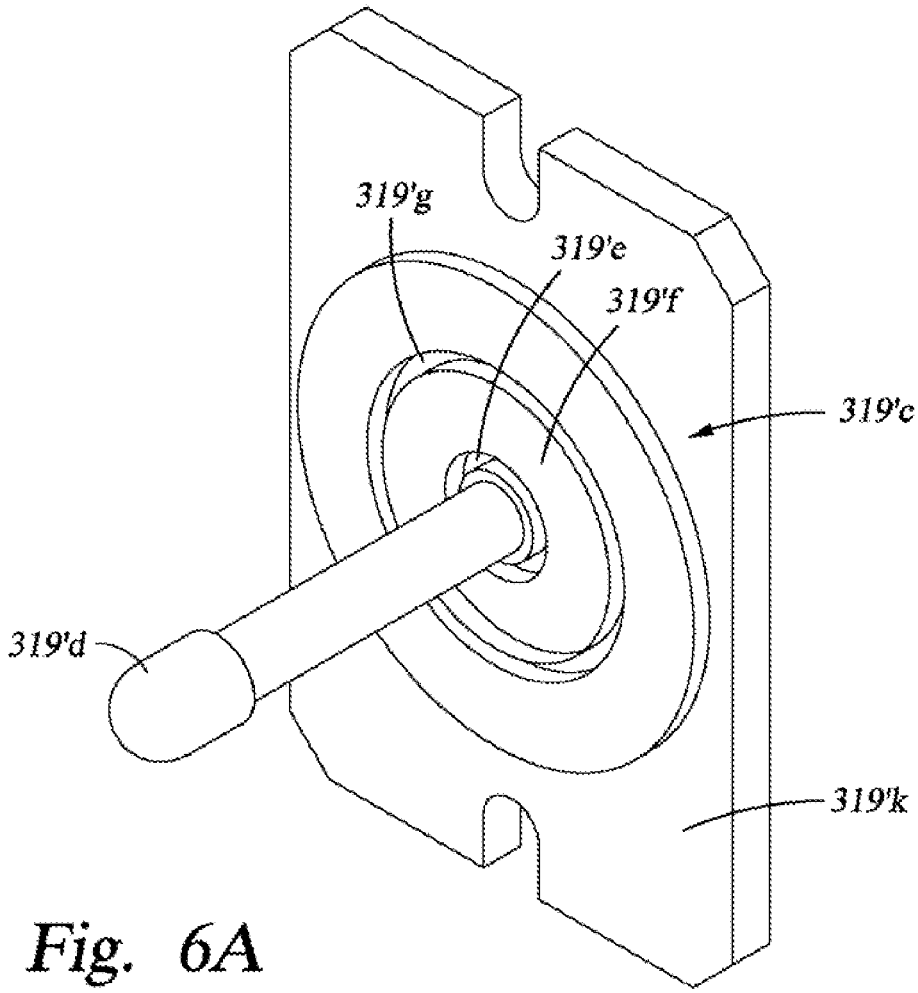
FIG. 6A is a schematic broken perspective of a packer portion of a tool, for example the tool of FIG. 3, having a guarded sampling packer around a drill shaft.
Figure 6B:
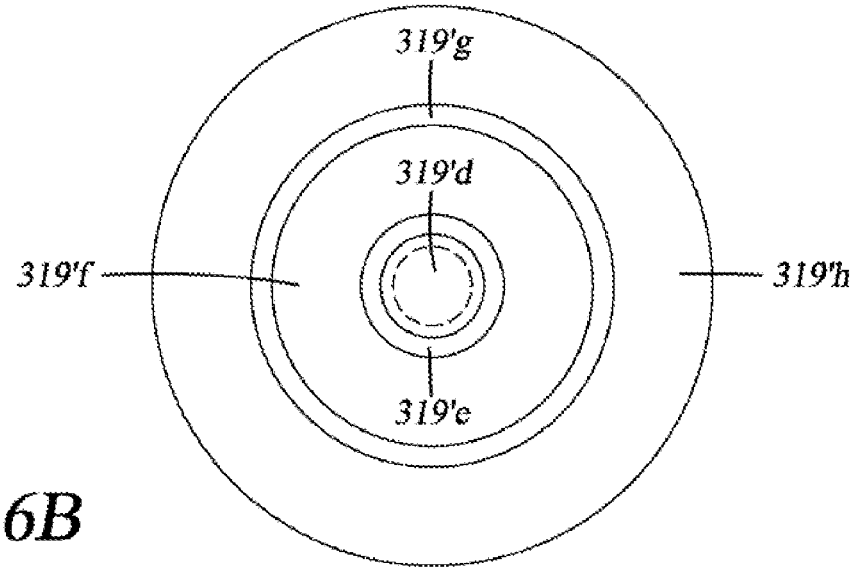
FIG. 6B is a schematic frontal view of the guarded packer of FIG. 6A.

FIGS. 6A and 6B illustrate a guarded packer 319'*c* which has a centrally positioned drilling element 319'*d* which is surrounded by an annular sampling conduit 319'*e*. The drill and the sampling conduit are surrounded by a compliant isolation element 319'*f* which serves to prevent hydraulic communication between the annular sampling conduit 319'*e* and the annular guard conduit 319'*g*, and an outer isolation element 319'*h*, both of which are shown mounted on a backing plate 319'*k*. A hydraulic circuit which can be adapted to control the guarded probe 319'*c* is shown in published U.S. Patent Application Pub. No. 2006/0042793.

The guarded packer 319'*c* is particularly useful in practicing some of the methods of the invention. For example, the guarded packer can be used for sampling viscous oils when the formation has been invaded by less viscous mud filtrate (for example water). The guarded packer 319'*c* has the advantage of very quickly sampling connate formation fluid in the sampling conduit 319'*c*. On the one hand, the hole drilled by the drill bit 319'*d* may bypass at least a portion of the zone of the formation invaded by mud filtrate. Thereby, the time required for the connate formation fluid to break through and reach the sampling conduit 319'*e* may be reduced. On the other hand, the guard conduit 319'*g* may be used to advantage for drawing mud filtrate away from the sampling conduit 319'*e*, reducing thereby the contamination by mud filtrate of the fluid entering the sampling conduit 319'*e*. Thus, the guarded packer 319'*c* is capable of obtaining pristine samples in a reduced time with respect to prior art probes, even in unfavorable conditions of a viscous formation fluid and a less viscous mud filtrate.

In other methods, the guarded packer 319'*c* may be used for injecting mobility enhancer, either through the sampling conduit 319'*e* or through the guard conduit 319'*g*. Consecutively or simultaneously, fluid may be drawn into the tool either through the sampling conduit 319'*e* or through the guard conduit 319'*g*.

While shown essentially circular on FIGS. 6A and 6B, the guarded packer 319'*c* may have any shape, for example an elongated shape in the direction of the tool longitudinal axis. Also, although the port of the guarded conduit 319'*g* is shown fully encircling the port of sample conduit 319'*e* in FIGS. 6A and 6B, the guarded conduit port may comprise a plurality of ports partially surrounding the sample conduit port.

Figure 7:
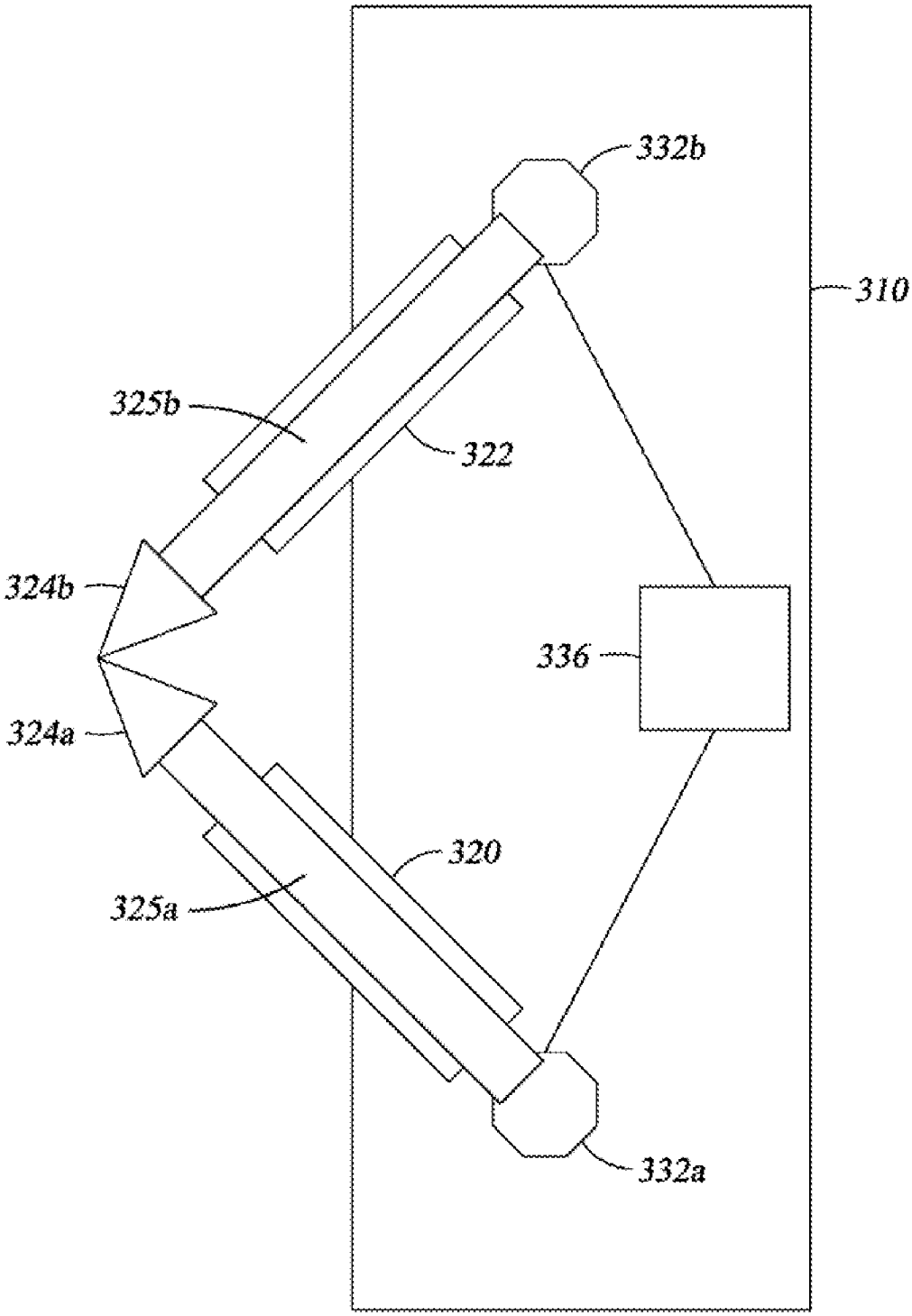
FIG. 7 is a schematic illustration of yet another sampling tool having formation drilling means.
Figure 7A:
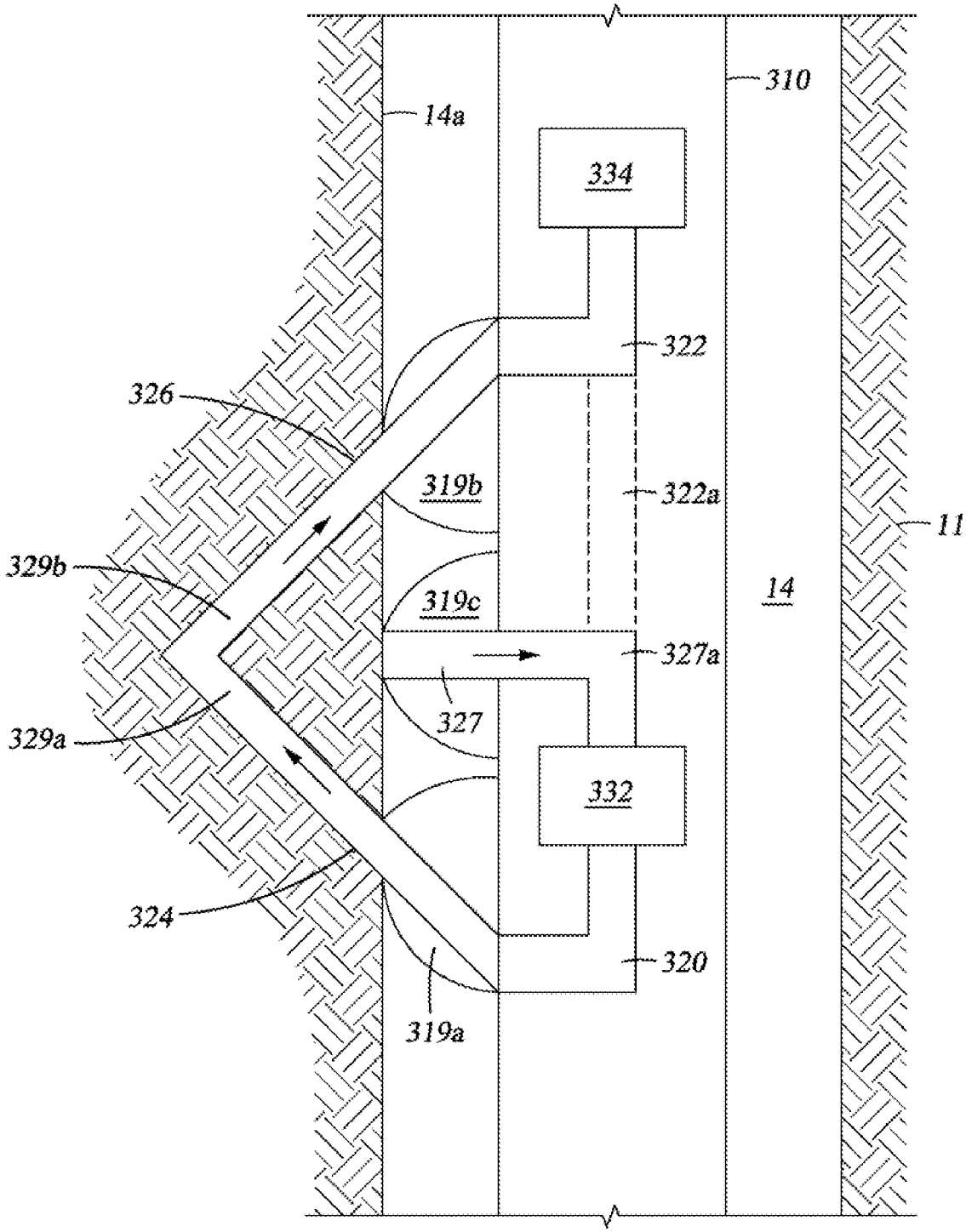
FIG. 7A is a schematic illustration of an additional components of the tool of FIG. 7 and being used according to some of the methods of this disclosure.

Turning now to FIGS. 7 and 7A, a fourth embodiment of a tool 310 includes two drills 324*a*, 324*b* with respective drill shafts 325*a*, 325*b* coupled to respective motors 332*a*, 332*b* which are powered by a power supply 336. The drills are arranged to drill two holes 329*a*, 329*b* into the formation 11 at angles oblique to the borehole wall 14*a*. In some cases, the drill shaft may be tilted or oriented by using a shaft guide. In other cases, a force may be preferentially applied on one side of the drill bit, as known for well directional drilling systems. The force may be applied in an essentially constant direction and the direction should not rotate as the drill bit rotates. The holes are drilled in such a way that they intersect inside the formation as shown in FIG. 7A. The tool 310 also includes flowlines 320 and 322 which are coupled to respective containers 332, 334 via valves (not shown). The tool 310 is preferably provided with packers 319*a*, 319*b* through which drills 324*a* and 324*b* extend and which establish a seal so that flowlines 320 and 322 are in fluid communication with holes 329*a*, 329*b*.

According to one method of using the tool 310, a mobility enhancer is delivered from the container 332 into the hole 329*a* via the flowline 320 and the probe 324. The mobilized formation fluid then flows through hole 329*b* into probe 326 and through flowline 322 to the container 334.

According to an alternate embodiment (seen in FIG. 7A), an additional probe 327 with a packer 319*c* is arranged between the probes 324, 326. The probe 327 is coupled to the container 332 via flowline 327*a*. In this embodiment, fluid may be collected at the borehole wall by the probe 327. The makeup of the fluid collected by probe 327 can be analyzed with a fluid analyzer (not shown) or other sensors. The fluid collected by probe 327 is optionally re-circulated into the container 332 via valves (not shown), particularly where the fluid is primarily mobility enhancing fluid. If the fluid is primarily formation fluid, the fluid may be forwarded via valves (not shown) to container 334 via flow line 322*a*. According to another alternate embodiment, no third probe is utilized. However, fluid flowing into probe 326 is analyzed with a fluid analyzer (not shown) or other sensors. If the fluid is primarily mobility enhancing fluid, the fluid is optionally recirculated into the container 332 via valves (not shown) and flow line 322*a*. If the fluid is primarily formation fluid, the fluid may be forwarded via valves (not shown) to container 334.

According to another aspect, the tool 310 of FIG. 7A can also be arranged such that mobility enhancing fluid is injected into the formation using all three probes 324, 326, and 327. The flow of fluids into and out of tool 310 can be enhanced by the use of pumps or pressure differentials.

According to a further aspect, the drills 324*a*, 324*b* of tool 310 can be provided with aspects of one or more of the drills 24, 124, 124' and 224 of FIGS. 2, 3, 4 and 5. Also, tool 310 can be provided with all or some of the other aspects of the embodiment of FIGS. 2 and 2A, including, but not limited to multiple pumps, multiple fluid storage containers, multiple valves, etc. In addition, tool 310 can be used in conjunction with any of the methods described above with reference to FIGS. 2 and 2A.

Figure 8A:
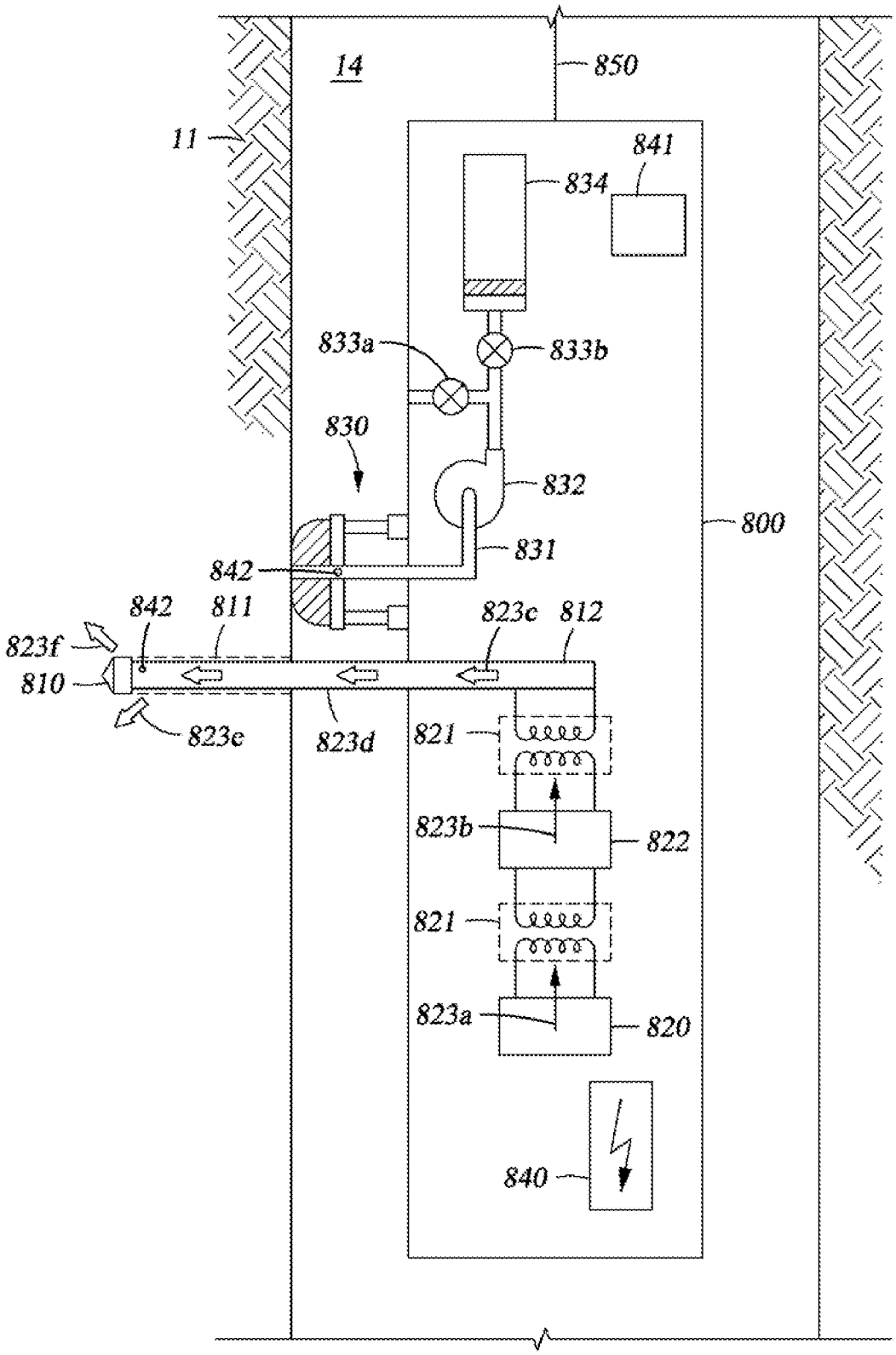
FIG. 8A is a schematic illustration of a sampling tool capable of enhancing the mobility of a reservoir fluid by delivering heat from a heat source.
Figure 8B:
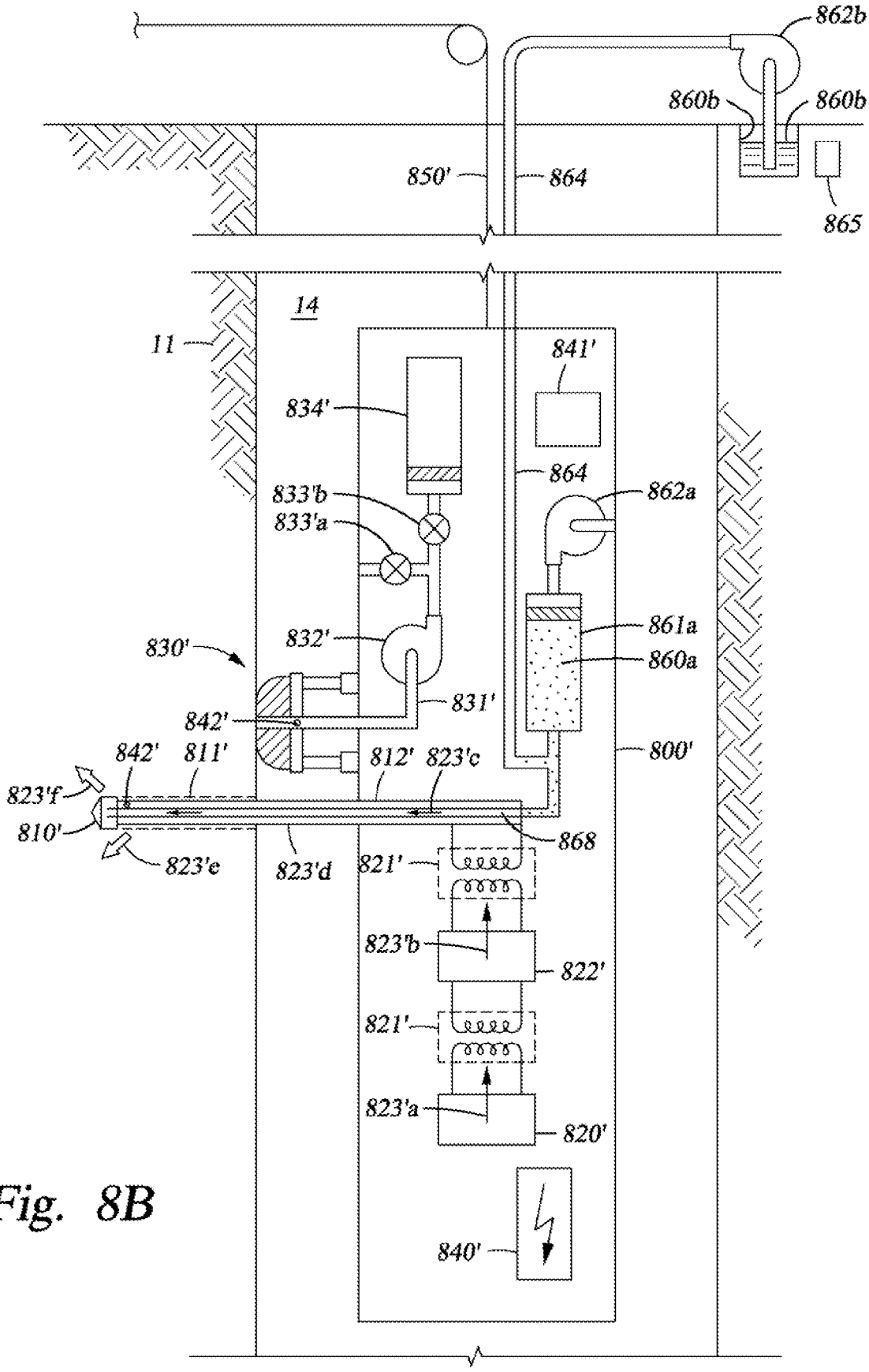
FIG. 8B is a schematic illustration of another sampling tool capable of enhancing the mobility of a reservoir fluid by delivering heat from a heat source.

Referring now to FIGS. 8A and 8B, sampling tools capable of delivering heat for enhancing formation fluid mobility are described in further details. The tool 800 (shown in FIG. 8A) and 800' (shown in FIG. 8B) are conveyed downhole with wireline cables 850 and 850' respectively. The tool 800 and the tool 800' comprise a sampling system. As shown, the sampling system may comprise at least extendable packers 830, 830', for establishing a fluid communication between the formation 11 and the tools 800 and 800' respectively. Downhole pumps 832 and 832' are hydraulically coupled to the packers 830 and 830' respectively via flowlines 831 and 831' respectively. The pumps may be used to advantage for lowering the pressure in the flowlines 830 or 831' below the formation pressure, while maintaining the pressure at the pump outlet above the wellbore pressure. Valves 833*a*, 833'*a* are communicatively coupled to controllers 841, 841' respectively, and may be used for selectively dumping pumped fluid in the wellbore 14. Similarly, valves 833*b*, 833'*b* are communicatively coupled to the controller 841 and 841' respectively, and may be used for selectively routing pumped fluid into fluid containers 834 and 834' respectively. The tools 800, 800' also comprise drill bits 810, 810' respectively, mechanically coupled to drill shafts 812, 812' respectively. The drill shaft 812, 812' are operated via a motor (not shown) as to drill a hole 811, 811' respectively, in the formation 11. The motor may be powered by a downhole battery 840, 840' or via the wireline cable 850, 850' or a combination. In these embodiments, the holes 811, and 811' may be used for delivering heat deeper into the formation 11, and thus, enhancing the oil mobility in a region adjacent to sampling packers 830, 830', expediting thereby the sampling process.

Turning now specifically to FIG. 8A, the tool 800 is configured for delivering heat to the formation 11 by thermal conduction. The tool 800 comprises a heat source 820. The heat source 820 may be the wellbore fluid, a resistive heater powered by any of the current provided by the wireline cable 850 or the battery 840, a chemical reactor where an exothermic chemical reaction is conducted, or some power electronics in the tool 800, for example the power electronics powering the pump 832. Optionally, the heat flow from the heat source 820 may be controlled by using a heat pump 822, thermally coupled to the heat source 820 and to the drill shaft 812 via optional heat exchangers 821. The heat pump 822 may be communicatively coupled to the controller 841 that controls the heating process based on temperature measurement(s) provided by the sensor(s) 842. Alternatively, the measurements of sensor(s) 842 may be telemetered to the surface via wireline cable 850, where they can be utilized by a surface controller or a surface operator for monitoring and controlling the heating and/or sampling process. In this embodiment, the drill shaft 812 preferably comprises a portion made of a good thermal conductor (not separately shown), for example copper or aluminum. This thermal conductor may further comprise a working fluid, for example water, and may operate as a heat pipe. Heat generated at the heat source 820 may then be delivered to the formation 11 by following the schematic path shown by arrows 823*a* to 823*f*. The heat delivered to the formation increases the temperature of the oil in the formation. The temperature increase of the oil translates into a viscosity decrease and thus a mobility enhancement. The mobilized oil may be sample by probe 830 and stored in fluid container 834 and brought to surface, for example for further analysis.

Turning now specifically to FIG. 8B, the tool 800' is configured for delivering heat to the formation 11 by thermal convection. The tool 800' may comprise a downhole heat source 820', thermally coupled to a downhole fluid 860*a* circulated in a flow line 868 in the shaft 812', for example as shown in greater detail in FIG. 5. The downhole fluid may be water or steam, depending on its temperature and pressure. The downhole heat source 820' may be similar to the downhole heat source 820 shown in FIG. 8A. The tool 800' may also comprise optional heat exchangers 821' and optional heat pump 822' similar to the heat exchangers 821 and the heat pump 822 shown in FIG. 8A. The downhole fluid 860*a* may be stored in a downhole tank 861*a* in the tool 800'. The downhole fluid 860*a* may be pressurized via a downhole pump 862*a* and injected into the formation at the hole 811'. The heat generated by the downhole source 820' is then transferred to the fluid 868, as schematically indicated by arrows 823'*a* and 823'*b*. The heat is then transported by the fluid into the formation as indicated by arrows 823'*c* to 823'*f*. Alternatively, or additionally, injection fluid may be provided from the surface as indicated by surface fluid 860*b* stored in surface tank 862*b*. The surface fluid may alternatively or additionally be pressurized by a surface pump 862*b*. The surface fluid may alternatively or additionally be heat at the surface via heater 865. The surface fluid is conveyed downhole via a pipe or tubing 864, in fluid communication with the flow line 868. It should be understood that any combination of downhole fluid, surface fluid, downhole pump, surface pump, downhole heater and surface heater may be used to advantage in this embodiment, and that the choice may depend on operational conditions such as depth of the formation, expected viscosity of the fluid to be sampled, etc.

While FIGS. 8A and 8B show heat delivered at a hole 811 or 811' in the formation 11, and a sampling probe sealed against a porous portion of the wall of the wellbore 14, it should be appreciated that the heat may be delivered at the wall of the wellbore using a packer 830, 830' or a straddle packer (not shown), and the formation fluid may be sampled at a hole in the wellbore 18, using for example the embodiment shown in FIGS. 6A and 6B. Further, it should be understood that the relative position of the heat delivery point and the sampling point may be reversed, i.e. the sampling point may be lower than the heat delivery point, for example to take advantage of gravity drainage. In particular, the heat delivery point and the sampling point may be located at the same level, for example the drill bit may be surrounded by a packer port. In addition, the holes drilled by the tools of FIGS. 8A and 8B may be oblique, as shown previously with respect to FIGS. 7 and 7A.

Figure 9:
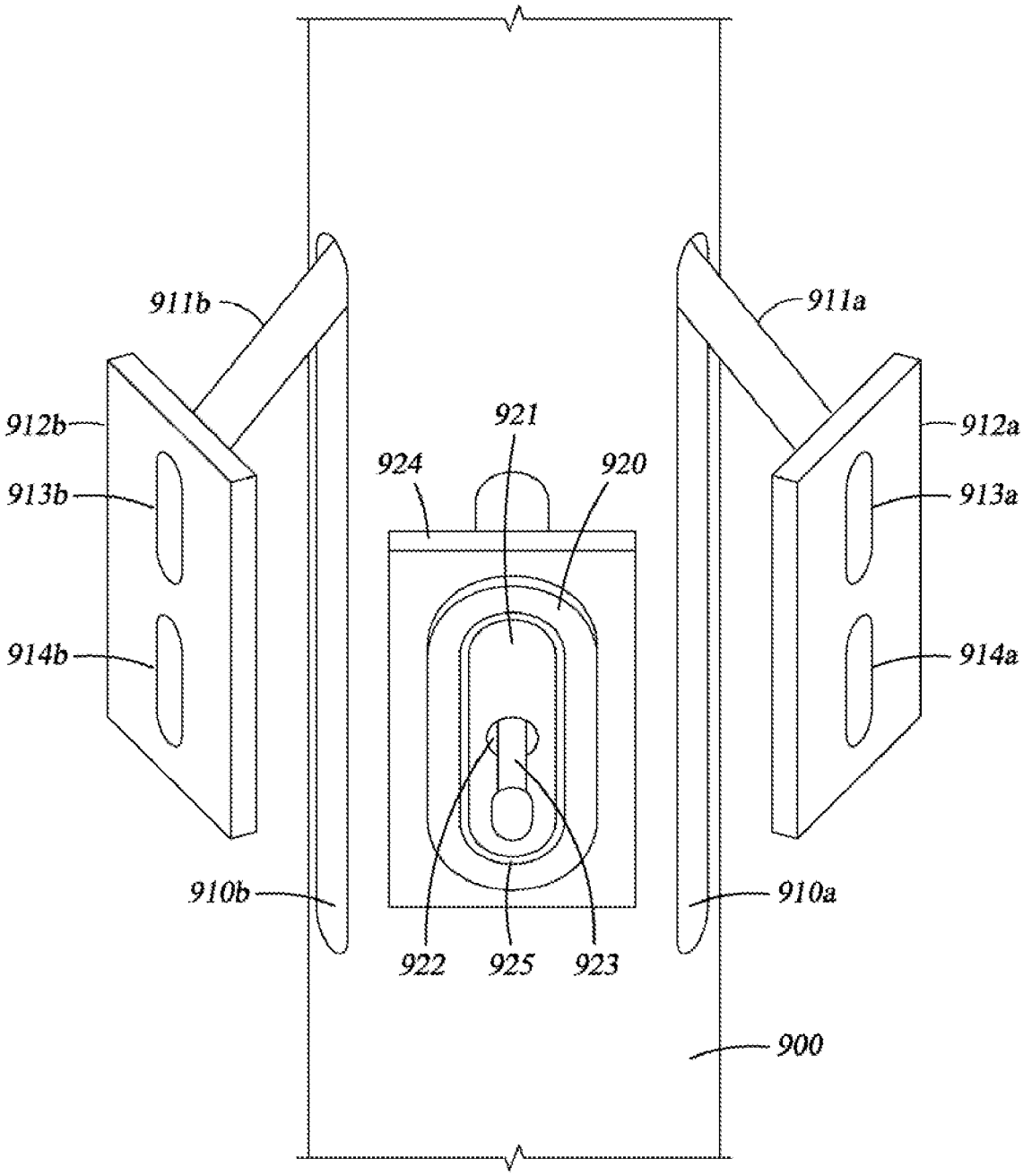
FIG. 9 is a schematic illustration of a packer portion of a tool capable of enhancing the mobility of a reservoir fluid by delivering heat with one or more electrodes.
Figure 10:
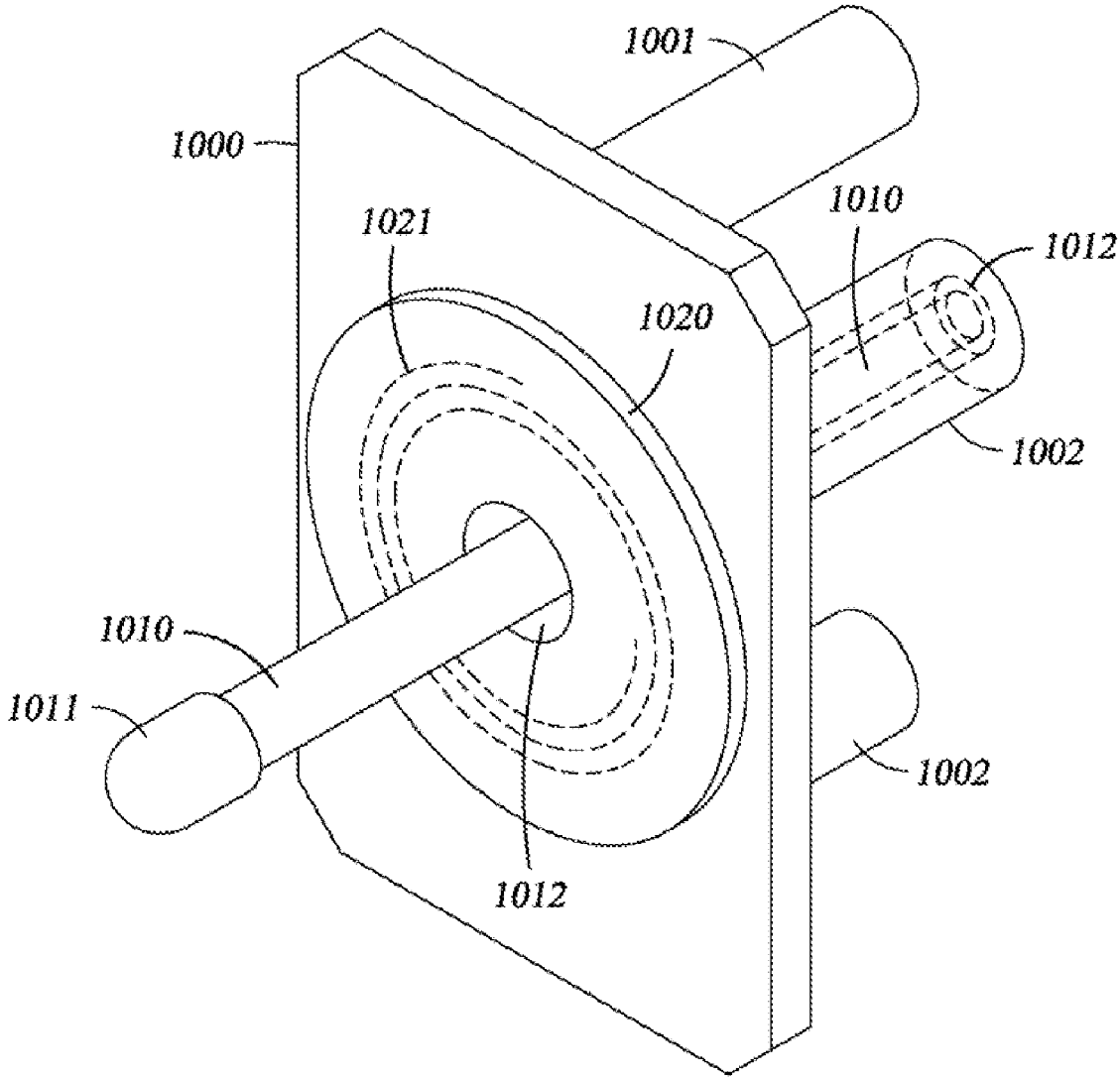
FIG. 10 is a schematic illustration of a packer portion of a tool capable of enhancing the mobility of a reservoir fluid by delivering heat with one or more induction coils.
Figure 11:
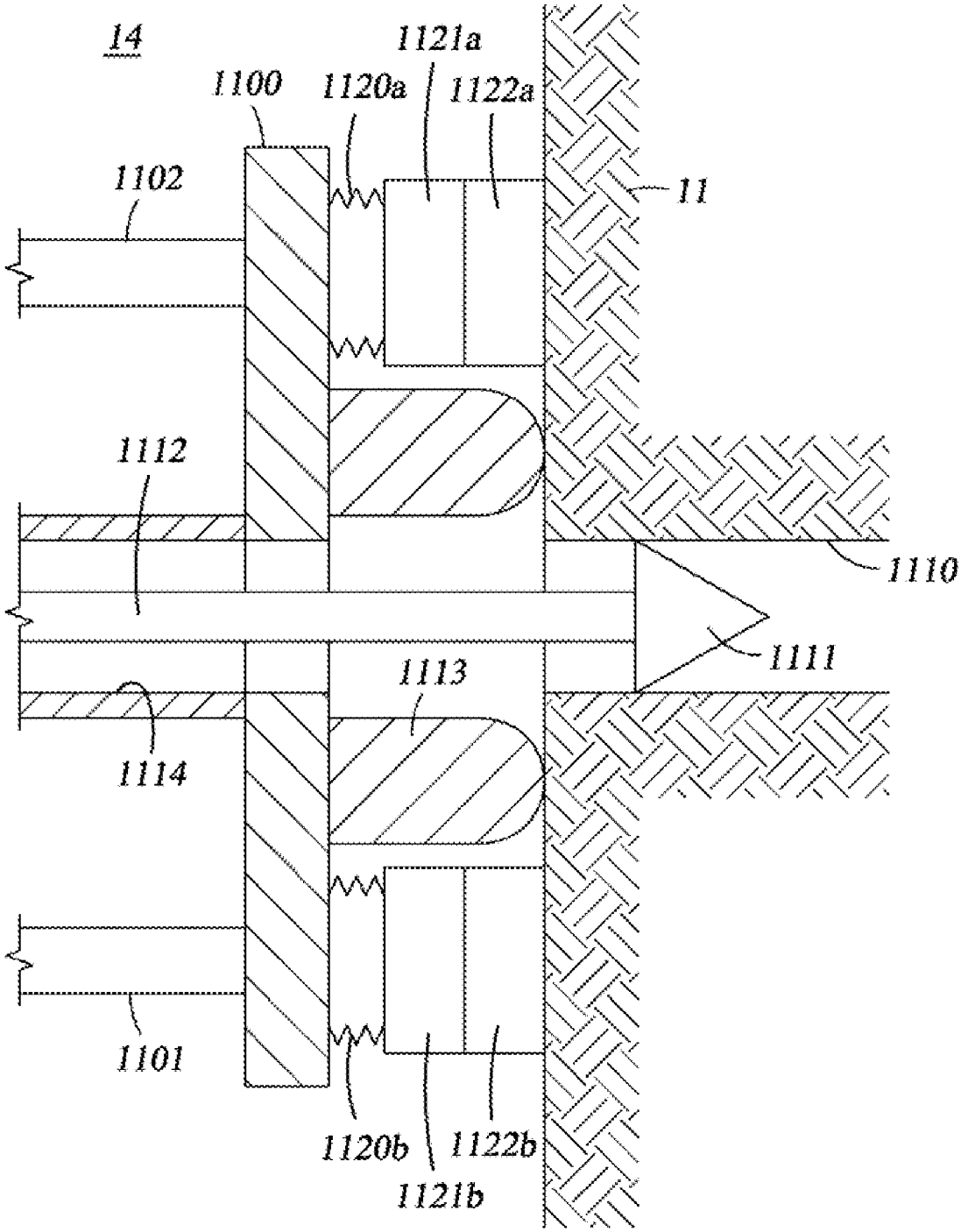
FIG. 11 is a schematic illustration of a packer portion of a tool capable of enhancing the mobility of a reservoir fluid by delivering heat with an ultrasonic emitter.

Referring now to FIGS. 9, 10, and 11, it should be noted that in these alternate embodiments, the mobility enhancer is a current or a wave propagating in the formation. These embodiments do not require having transmitters physically introduced in a hole into the formation for delivering the mobility enhancer to the formation. For example in FIG. 9, a portion of a tool 900 is shown having, articulated pads 912*a* and 912*b*. These pads may be placed against the formation by the tool, using known deployment means, such as arms 911*a* and 911*b* respectively. When not used, the pads are preferably recessed below the outer surface of the tool, for example in apertures 910*a* and 910*a* in the tool body. As shown, the pads may include a plurality of electrodes such as electrodes 913*a*, 914*a* on pad 912*a* and electrodes 913*b* and 914*b* on pad 912*b*. In one embodiment, the electrodes on each pad may be kept at the same potential, and a potential difference in applied between the group of electrodes on each pad. This potential difference may be constant or may vary with time, and is provided by a electrical power source at surface or in the tool 900. Thus, current flows between two or more pads, at least in part in the formation. In another embodiment, a potential difference is applied between electrodes on a same pad. Thus, current flows between electrodes as desired. In both embodiments, the current may flow preferably in the invaded zone of the formation, especially if the mud filtrate has a better conductivity that the oil in the formation. In some cases, the current flow generates heat in the formation. The mobility enhancer is heat that is introduced into the formation by thermal conduction or thermal convection if fluids in the formation are displaced, for example when injection from the tool is also used.

The tool 900 is also provided with an extendable packer 920 for establishing a fluid communication between the tool and the formation. The packer may be detachably coupled to a backing plate 924 for facilitating the replacement thereof. The packer 920, made of a resilient material may comprise an internal support 925 for preventing deformation of the packer under pressure differential between the wellbore and the tool. The packer is also provided with a recess 921 and a port 922 for the flow of wellbore fluids in the tool when the packer is applied against the wellbore wall. The packer is provided with a drilling means 923, for drilling a hole in the wellbore wall. The hole may be used for facilitating the injection of fluids from the tool 900 or for drawing formation fluid in the tool 900 and capturing a sample. In particular, fluid may be injected in the formation for modifying locally the resistivity of the formation and improving the efficiency of the heating via pads 912*a* and/or 912.

Although shown with electrodes, the pads 912*a* and 912*b* may alternatively comprise any of electromagnetic antenna (e), acoustic transmitter(s), resistor(s) or other element(s) for generating heat. Further, the heating pads can be configured with one or more inlets through which a hole is drilled into the formation. The inlet may be in fluid communication with the tool so that the formation fluid can be sampled. Also, the heating elements, or electrodes, on the pad are preferably arranged so that the depth to which the heat is able to penetrate into the formation is sufficient for mobilizing a volume of oil corresponding to the sampling requirements and are not limited to two per pads. Similarly, any number of pads may be used and the tool 900 is not limited to two pads.

Turning now to FIG. 10, a packer portion of a tool capable of enhancing the mobility of a reservoir fluid by delivering heat with one or more induction coils is shown in greater details. The packer of FIG. 10 comprises a backing plate 1000 pivotally mounted on extendable pistons 1001 and 1002 on a downhole tool (not shown). The backing plate 1000 supports a packer 1020 for isolating a port 1012 of the downhole tool from the wellbore when the packer is pushed against a wellbore wall (not shown). The packer may be provided with a drill shaft 1010 and a drill bit 1011 at a distal end thereof for drilling a hole in a formation wall. The tool is may be in fluid communication with the drilled hole, through the cylinder 1003 and the port 1012.

In FIG. 10, a coil 1021 is shown embedded in the packer 1020 body. The coil may have any number of turns. The coil 1021 is driven preferably by an alternate current source (not shown), for example in the tool body. The driving frequency may be of the order of kHz, or of the order of radio frequencies. As shown on FIG. 10, the coil may be configured to surround the drill shaft 1010 and may be used for generating an alternate magnetic field essentially aligned with a drilled hole (not shown) in the formation. Current induced by the coil may flow in the formation. In this configuration, the current lines typically are circles surrounding the drilled hole.

Referring now to FIG. 11, a packer portion of a tool capable of enhancing the mobility of a reservoir fluid by delivering heat with an ultrasonic emitter is shown in cross section. As described in FIG. 11, a packer 1113 is pressed against the formation 11 for establishing a fluid communication between an inlet 1114 of a downhole tool and the formation. The packer 113 is supported by a backing plate 1100 extended towards the wellbore wall via pistons rams 1102 and 1101. The probe portion is preferably capable of drilling a hole 1110 in the formation 11 with a drill bit 1111 mounted at the distal end of a drill shaft 1112 operated by the tool.

The backing plate 1100 of FIG. 11 is further provided with ultrasonic emitters for generating heat in the formation. As shown in FIG. 11, two emitters comprise piezoelectric disks 1121*a* and 1121*b*. The disks may be polarized in their thickness and may be driven by the tool at or near the thickness resonance. The emitters may further comprise adaptation layers 1122*a* and 1122*b* respectively, for enhancing the acoustical coupling of the piezoelectric disks (high acoustic impedance) to the formation (low acoustic impedance). The adaptation layers may further be pressed against the formation by using spring members 1121*a* and 1121*b*, for example Belleville washer stacks. It should be understood that while two emitters are shown on FIG. 11, any number of emitter may be used instead.

There have been described and illustrated herein many embodiments of methods and apparatus for modifying a formation in order to obtain a formation fluid sample. While particular embodiments have been described, it is not intended that the invention be limited thereto, as it is intended that the invention be as broad in scope as the art will allow and that the specification be read likewise.

Thus, while some embodiments have been disclosed with reference to two drills, it will be appreciated that a tool with one drill could be used if only one hole is to be drilled, or if the tool is moved between first and second drilling locations. Similarly, while an embodiment has been shown with two drills which drill in a manner oblique to the formation, it will be appreciated that a single drill could be utilized which can be controllably angled relative to the borehole wall. In this manner, a first oblique hole can be made, and then the drill moved to a second location either by moving the drill within the tool or by moving the tool, and the drill reset at another angle so that a second hole can be made which may or may not intersect the first hole. In fact, the second hole can be perpendicular to the borehole wall or oblique relative thereto. Alternatively, a perforation mechanism other than a drill may be used to create one or more holes into the formation. For example, the perforation mechanism may include, but is not limited to, perforation guns.

Also, while the disclosure described delivering a mobility enhancer into the formation with the drill(s) in place in the formation, it will be appreciated that the drill(s) could be withdrawn from the formation prior to the introduction of a mobility enhancer. Thus, the delivery of the mobility enhancer and the sampling of formation fluids can occur with the drill(s) withdrawn into the tool or with the drill(s) located in the formation. Alternatively, a shaft that may not include a drill bit at its end may be introduced in the formation after the hole has been drilled and perform operations similar to a shaft with a drill bit. Further, it will be appreciated that while the disclosure described sealing a location along the borehole wall with a packer, and then drilling into the formation at the isolated location(s), it is within the scope of the disclosure to use the drill(s) to drill into the formation without first isolating the drilling location with a packer. In this way, the drill(s) of the tool need not be located at the packer or probe locations. With the drill(s) displaced from the packers or probes, the methods of utilizing the tool can be modified such that after drilling a hole or holes, the drill(s) could be withdrawn into the tool and then the tool can be moved so that the packer or probe will locate at or around the hole(s) in order to establish a fluid path between the drilled hole(s) and the tool. Once the fluid path is established, any of the described methods of the invention can be utilized.

Those skilled in the art will appreciate that the tool can also be provided with backup anchoring pistons or other anchoring means. Further, while various embodiment of a tool according to this disclosure are shown with specific features, a downhole tool having features found in different figures, or combining features found in this disclosure with features known in the art, is to be considered within the scope of this disclosure. In particular, downhole tools combining means of delivering a mobility enhancer may be used to advantage in some cases, for example, a tool combining two or more means for delivering heat. Similarly, a system comprising a plurality of tools including the feature(s) shown in one or more tools described in this disclosure is within the scope of this disclosure.

Also, while the embodiments of the disclosure were illustrated in details for a tool conveyed by a wireline cable, those skilled in the art and given the benefit of the disclosure will appreciate that the scope of the disclosure includes tools deployed through other conveyance means. In particular, the tools and methods discussed herein may be used in a drilling situation, i.e. when the tool conveyed/deployed as part of a bottom hole assembly or on drill pipe. In this example, the tool string is preferably equipped by a power source and a downhole-surface telemetry system known in the art and suitable to a conveyance mode by string. Note also that a tool conveyed of drill pipe may or may not be equipped with a drill bit and may be used alternatively for appraising a well or a reservoir.

Finally, while the embodiments of the disclosure were primarily directed to drilling into a formation from an uncased borehole, it will be appreciated that the described apparatus and methods can be utilized even if the borehole is cased. It will therefore be appreciated by those skilled in the art that yet other modifications could be made to the provided invention without deviating from its spirit and scope as claimed.

What is claimed is:

1. A method of obtaining a fluid sample from an underground formation traversed by a borehole, comprising:

lowering a tool into the borehole, the tool including at least one perforation mechanism disposed through a sidewall of the tool, and at least one port fluidly connected to a sample container;

creating a first hole through a borehole wall into the formation with the at least one perforation mechanism;

increasing a mobility of formation fluid, wherein the formation fluid is disposed between the borehole wall and the first hole, wherein increasing the mobility includes engaging at least one of a packer and a pad against the borehole wall and activating a heating element disposed in the at least one of the packer and the pad; and obtaining a sample of fluid from the formation, wherein at least one of increasing and obtaining is performed utilizing the first hole.

2. A method according to claim 1, wherein both increasing and obtaining are performed utilizing the first hole.

3. A method according to claim 1, wherein creating the first hole includes drilling the first hole in the borehole wall with a drill bit.

4. A method according to claim 1, wherein increasing the mobility includes injecting a fluid into the formation.

5. A method according to claim 4, further comprising mixing at least two fluids downhole.

6. A method according to claim 4, wherein injecting the fluid includes injecting the fluid into the first hole.

7. A method according to claim 4, further including providing the fluid from the surface.

8. A method according to claim 1, wherein increasing the mobility includes extending a pipe into the first hole.

9. A method according to claim 8, further comprising heating the pipe.

10. A method according to claim 8, wherein obtaining the sample is performed via the pipe.

11. A method according to claim 1, further comprising creating a second hole through the borehole wall into the formation.

12. A method according to claim 11, wherein obtaining the sample is performed through utilizing the second hole.

13. A method according to claim 1, further comprising analyzing the sample in the borehole tool.

14. A system for obtaining a sample of formation fluid from a hydrocarbon reservoir traversed by a borehole, system comprising:

at least one perforation mechanism disposed on a sidewall of a downhole tool, for creating a first hole through a borehole wall into the formation;

an injection port disposed on a sidewall of the downhole tool; the injection port being adapted to inject fluid into the formation for enhancing the mobility of formation fluid located adjacent the first hole; and a sampling port disposed on a sidewall of the downhole tool, the sampling port being fluidly connected to a container disposed in the downhole tool;

wherein one of the at least one perforation mechanism and a second perforation mechanism creates a second hole in the formation hole;

wherein the injection port injects fluid into the first hole and the sampling port samples the formation fluid from the second hole;

wherein the injection port is fluidly connected to a tank located on the surface; and wherein the injection fluid is at least one of air and oxygen for creating an in-situ combustion.

15. A method of obtaining a fluid sample from an underground formation traversed by a borehole, comprising:

lowering a tool into the borehole, the tool including at least one perforation mechanism disposed through a sidewall of the tool, and at least one port fluidly connected to a sample container;

creating a first hole through a borehole wall into the formation with the at least one perforation mechanism;

increasing a mobility of formation fluid disposed between the borehole wall and the first hole by generating electromagnetic radiation, wherein the electromagnetic radiation spectrum comprises a frequency coincident with an absorption frequency of the formation fluid, an injected fluid, or connate water; and obtaining a sample of fluid from the formation, wherein at least one of increasing and obtaining is performed utilizing the first hole.

* * * * *